US007899342B2

(12) United States Patent
Kamei et al.

(10) Patent No.: US 7,899,342 B2
(45) Date of Patent: Mar. 1, 2011

(54) IMAGE FORMING APPARATUS

(75) Inventors: Kayo Kamei, Nara (JP); Motokazu Nakao, Nara (JP); Masatsugu Hatanaka, Osaka (JP); Shigeru Yoshida, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 537 days.

(21) Appl. No.: 10/553,981

(22) PCT Filed: Apr. 9, 2004

(86) PCT No.: PCT/JP2004/005188

§ 371 (c)(1),
(2), (4) Date: Oct. 20, 2005

(87) PCT Pub. No.: WO2004/096683

PCT Pub. Date: Nov. 11, 2004

(65) Prior Publication Data

US 2006/0228122 A1 Oct. 12, 2006

(30) Foreign Application Priority Data

Apr. 25, 2003 (JP) ..... 2003-121899

(51) Int. Cl.
*G03G 15/00* (2006.01)
*B65H 43/00* (2006.01)
*B65H 43/02* (2006.01)

(52) U.S. Cl. ..... 399/23; 399/21

(58) Field of Classification Search ..... 399/23; 271/157–167
See application file for complete search history.

(56) References Cited

U.S. PATENT DOCUMENTS 6,876,819 B2 * 4/2005 Sawada et al. ..... 399/9
7,002,702 B1 * 2/2006 Machida ..... 358/1.15

FOREIGN PATENT DOCUMENTS

JP 55156153 A * 12/1980
JP 57160844 A * 10/1982
JP 59-53342 3/1984
JP 61-235336 10/1986
JP 62-111851 5/1987
JP 4-106030 4/1992

(Continued)

OTHER PUBLICATIONS

English translation of JP Pub 2000-335784.*

(Continued)

*Primary Examiner*—Daniel J Colilla
*Assistant Examiner*—Allister Primo
(74) *Attorney, Agent, or Firm*—Nixon & Vanderhye, P.C.

(57) ABSTRACT

When forming an image, if there are not enough sheets remaining in a paper feed cassette to satisfy the image forming request, the image forming operation is not executed, and along with prompting the user to refill the paper, the paper feed cassette is pushed out towards an uninstalled state. The apparatus waits for a paper refill, and begins the image forming operation after that paper refill.

13 Claims, 7 Drawing Sheets

FOREIGN PATENT DOCUMENTS

| | | | | |
|---|---|---|---|---|
| JP | 5-301430 | | | 11/1993 |
| JP | 8-151164 | | | 6/1996 |
| JP | 408157104 | A | * | 6/1996 |
| JP | 9-208086 | | | 8/1997 |
| JP | 10-10816 | A | | 1/1998 |
| JP | 11231730 | A | * | 8/1999 |
| JP | 2000-313533 | | | 11/2000 |
| JP | 2000-335784 | | | 12/2000 |
| JP | 2002-3014 | | | 1/2002 |

OTHER PUBLICATIONS

English translation of JP Pub 2000-313533.*
English translation of JP Pub 62-111851.*
International Search Report of PCT/JP2004/005188, mailed May 18, 2004.

* cited by examiner

IMAGE FORMING APPARATUS

This application is the US national phase of international application PCT/JP2004/005188, filed 9 Apr. 2004, which designated the U.S. and claims priority of JP 2003-121899, filed 25 Apr. 2003, the entire contents of each of which are hereby incorporated by reference.

TECHNICAL FIELD

The present technology relates to an image forming apparatus. Specifically, it relates to improving a processing operation when there are not enough sheets remaining in a paper feed cassette to satisfy the requested number of image forming sheets.

BACKGROUND ART

Conventionally, in image forming apparatuses such as copying machines, printers, and the like, a paper feed cassette is provided that stores recording paper supplied to an image forming portion. Ordinarily, in order for it to be possible to refill and exchange recording paper in this paper feed cassette, it is installed so that the paper feed cassette can be inserted and removed from the main body of the image forming apparatus. Also, this paper feed cassette is provided with a rotating board (also referred to as a lift board) that can rotate in the vertical direction while supporting the recording paper. A coil spring is disposed on the underside of this rotating board, and biasing force is conferred on the rotating board in the upward direction by this coil spring. Therefore, when the paper feed cassette loaded with paper is inserted in the main body of the image forming apparatus, the uppermost sheet of recording paper faces or makes contact with a pickup roller, and it is possible for paper to be supplied from the paper feed cassette toward an image forming portion by the rotation of this pickup roller.

On the other hand, in this type of image forming apparatus, the achievement of a reduction in the installation space of the apparatus has been sought, and in response, image forming apparatuses have been developed wherein a paper feed portion (the paper feed cassette) is disposed in the lower portion, an original capturing portion (scanner portion) is disposed in the upper portion, and an image forming portion (print portion) and a discharge portion (discharge tray) are provided between the paper feed portion and the original capturing portion. That is, a reduction in the installation space of the image forming apparatus is achieved by adopting a configuration such that the discharge tray does not protrude in the lateral direction of the apparatus. Also, in this image forming apparatus, the paper feed cassette, the scanner portion, and the print portion are arranged in the shape of a sideways U in a front perspective of the apparatus. Therefore, the discharge tray is configured as an intermediate space open in the lateral direction (one side of the sideways U shape is open), and printed materials discharged to this intermediate space portion are removed from the front side or the lateral side (the open side described above) of the apparatus.

However, in an image forming apparatus with this sort of configuration, because the paper feed cassette is disposed in the lower portion of the apparatus, when the user wants to check the amount of paper remaining in the paper feed cassette, he must, in a bent over posture, pull the paper feed cassette out of the main body of the image forming apparatus and visually check the remaining paper. Particularly, when the user is a disabled individual, this checking operation is extremely bothersome and requires time.

Also, when the image forming apparatus stops during a printing operation, it is necessary for the user to check the reason for the stop, and afterwards take action to deal with the problem, and when the cause of the stoppage is an exhausted supply (during a printing operation there is no paper remaining in the paper feed cassette), after pulling out the paper cassette and visually confirming that there is no paper remaining, as described above, the user prepares paper and refills the paper feed cassette. This action requires a long period of time, during which print jobs are erased, and when there are image forming requests from other users during that period of time, multiple print jobs accumulate in the memory of the image forming apparatus, and an insufficient memory status may result.

As a way of solving this problem, for example, JP 2000-313533A discloses technology wherein when there is no paper remaining in the paper feed cassette during execution of a print operation, the paper feed cassette is automatically pushed out a small amount from its installed state. By doing so, the user can quickly confirm that the supply is exhausted without pulling out the paper cassette.

However, in the technology disclosed in JP 2000-313533A, when the image forming apparatus stops during a printing operation, the user can not confirm that the supply is exhausted unless he goes to the location where the image forming apparatus is installed and visually checks the condition of the paper feed cassette. Therefore, when refill paper is stored in a different location than the printer is installed, the user must go to the storage location to get refill paper after going to the installed location of the image forming apparatus and confirming that the supply is exhausted, and again return to the location in which the image forming apparatus is installed.

Also, ordinarily, when an image request signal is given from a terminal on a network to the image forming apparatus, a printer mark (a mark indicating that a print operation is in progress) is displayed on the display of this terminal, but when the user has confirmed that this display has not disappeared for a long time, it is necessary for the user to move to the location where the image forming apparatus is installed and check the reason that the print operation has not completed. That is, after the image forming request signal is given from the terminal to the image forming apparatus, though another operation is being performed on that terminal, this operation must be temporarily interrupted and the reason that the print operation has not completed must be confirmed, worsening operating efficiency.

The present technology was made with the foregoing in mind, and it is an object thereof to provide an image forming apparatus wherein a state is not incurred in which, if a user gives an image forming request when there are few sheets of paper remaining in the paper feed cassette, the supply is exhausted during the image forming operation, and the user must move to the location in which the image forming apparatus is installed and perform a confirmation operation, nor a state in which an operation of the user is temporarily interrupted.

DISCLOSURE OF PRESENT TECHNOLOGY

Overview of the Present Technology

In order to achieve the object stated above, in accordance with the present technology, if there are not enough sheets remaining in the paper feed cassette to satisfy an image forming request when forming an image, waits for a paper refill is awaited without executing the image forming operation, and the image forming operation is begun after that paper refill. When awaiting this paper refill, along with prompting the user to refill the paper, the paper feed cassette is popped out and the lack of paper can easily be confirmed.

Solving Means

Specifically, an image forming apparatus is presumed that is provided with a paper feed cassette and an image forming portion, and takes out a recording medium stored in this paper feed cassette sheet by sheet in response to an image forming request and performs image forming in the image forming portion. This image forming apparatus is provided with a push-out means, a warning means, a sheet quantity confirming means, and a control means. The push-out means can push out the paper feed cassette from an installed state toward an uninstalled state relative to the main body of the apparatus. The warning means can emit a warning that there is insufficient paper to a user who requested image forming. The sheet quantity confirming means can confirm the number of sheets of the recording medium stored in the paper feed cassette. The control means causes the sheet quantity confirming means to confirm the number of sheets of the recording medium stored in the paper feed cassette when an image forming request has been received, and if the number of sheets of the recording medium stored in the paper feed cassette is lower than the number of sheets requested by the image forming request, the control means causes the paper feed cassette to be pushed out from an installed state toward an uninstalled state by the push-out means without executing the image forming operation, and causes the user to be warned by the warning means that the number of sheets of the recording medium is insufficient.

With these specified items, when the image forming apparatus receives an image forming request signal, the sheet quantity confirming means confirms the number of sheets of the recording medium that are stored in the paper feed cassette. When the confirmed number of sheets (the number of sheets of paper remaining in the paper feed cassette) is greater than the requested number of image forming sheets, that is, when the image forming operation can be completed from the remaining recording medium, the image forming operation is executed in that state.

On the other hand, when the confirmed number of sheets (the number of sheets of paper remaining in the paper feed cassette) is lower than the requested number of image forming sheets, that is, in a condition in which when executing the image forming operation as-is, the paper will run out during image forming, the paper feed cassette is pushed out from an installed state toward an uninstalled state with the push-out means without beginning the image forming operation, and the user is warned by the warning means that the number of sheets of the recording medium is insufficient. Thus the user can immediately confirm that a refill of the storage medium (paper) is necessary, and immediately begin the work of refilling the paper without the need to confirm the status of the image forming apparatus. Thus, when the refill recording medium is stored in a different location than the image forming apparatus is installed, the user can go to get the recording medium from the storage location of the refill recording medium without going to the installed location of the image forming apparatus, and then go to the installed location of the image forming apparatus and perform the work of refilling the paper. That is, the activity of approaching the installed location of the image forming apparatus and confirming that there is no paper remaining, prior to going to the storage location of the recording medium, is no longer necessary. And, it is possible to allow the user to confirm the lack of paper within a short period of time after sending an image request signal from a terminal to the image forming apparatus. That is, after the user has sent an image request signal and before beginning separate work on that terminal, it is possible to prompt the user for a paper refill as necessary, and so it is possible to avoid temporarily interrupting work on the user terminal after it has been begun.

The following is given as a specific configuration of the control means. That is, when an image forming request has been received from a terminal machine through a network, the control means lets the sheet quantity confirming means confirm the number of sheets of the recording medium stored in the paper feed cassette, and if the number of sheets of the recording medium stored in the paper feed cassette is lower than the number of sheets requested by the image forming request, the control means the paper feed cassette to be pushed out from an installed state toward an uninstalled state by the push-out means without executing the image forming operation, and the user is warned by the warning means that the number of sheets of the recording medium is insufficient.

That is, this solving means is a configuration in the case of having the image forming apparatus function as a printer on a network. Particularly, in this case, because the user is always in the installed location of the terminal machine (user terminal), in the conventional technology, when the image forming apparatus stops during a printing operation, it is difficult to quickly confirm the reason for the stoppage. With the present solving means, before the printing operation is begun, it is possible to have the user confirm that if the print operation is executed in the present state the print operation will be stopped before it completes due to the supply being exhausted.

The following is specifically given as a configuration of the sheet quantity confirming means.

First, a paper storage board is provided in the paper feed cassette that, along with supporting the recording medium, moves to a lower position as the number of stored sheets of the recording medium increases. The sheet quantity confirming means is configured so as to confirm the number of sheets of the recording medium stored in the paper feed cassette by detecting the height position of the paper storage board with a reflective optical sensor.

Also, as another configuration of the sheet quantity confirming means, it is provided with a matching portion made of metal that extends in the vertical direction along the edge of the stored recording medium and matches the recording medium, and a paper storage board made of metal that is movable along this matching portion in the vertical direction while contacting this matching portion and that moves to a lower position as the number of stored sheets of the recording medium increases. The sheet quantity confirming means is configured so as to let a current flow from the paper storage board to the matching portion, and confirm the number of sheets of the recording medium stored in the paper feed cassette based on the electrical resistance from the paper storage board to the matching portion, which changes according to the height position of the paper storage board.

From these specified items, it is possible to confirm the number of sheets (remaining sheets) of the recording medium stored in the paper feed cassette with a comparatively simple configuration. Particularly, in the configuration that confirms the number of sheets of the recording medium based on the electrical resistance, by utilizing the fact that, from the related art, the rotating board and the matching portion are made of metal, it is possible to confirm the number of sheets of the recording medium without requiring a special electric circuit.

The following is given as a specific configuration of the push-out means. That is, the push-out means is provided with an engaging mechanism that can switch between an engaged state and a released state of the paper feed cassette relative to the main body of the apparatus, and a biasing portion that confers a biasing force on the paper feed cassette in the push-out direction, and when the number of sheets of the recording medium stored in the paper feed cassette is lower than the requested number of image forming sheets, the engaging mechanism puts the paper feed cassette in a released state relative to the main body of the apparatus.

By these specified items, when an image forming request has been received, when the number of sheets of the recording medium stored in the paper feed cassette is lower than the requested number of image forming sheets, the engaging mechanism puts the paper feed cassette in a released state relative to the main body of the apparatus, and thus the paper feed cassette is pushed out from the main body of the apparatus by the biasing force of the biasing portion. That is, it becomes possible to realize a push-out means with a simply configured engaging mechanism such as a solenoid, for example, and an improvement in practicality can be realized.

The following is given as a timing of the operation of various means described above. That is, the control means is configured so that immediately after an image forming request has been received, the control means causes the sheet quantity confirming means to confirm the number of sheets of the recording medium stored in the paper feed cassette, and if the number of sheets of the recording medium stored in the paper feed cassette is lower than the number of sheets requested by the image forming request, the control means causes the paper feed cassette to be pushed out from an installed state toward an uninstalled state by the push-out means without executing the image forming operation, and the control means causes the user to be warned by the warning means that the number of sheets of the recording medium is insufficient. In this way, because an operation according to the number of sheets of the recording medium in the paper feed cassette is performed immediately after the image forming request has been received, after a user sends an image request signal, it is possible to reliably prompt the user to refill paper before beginning other work on that terminal, and avoid the need to temporarily interrupt work on that terminal.

BEST MODE FOR CARRYING OUT THE PRESENT TECHNOLOGY

Hereinafter, the present technology will be described by way of illustrative embodiments with reference to the drawings. In the present example embodiment, the present technology is described with regard to its application in a compound machine provided with a copy function, a print function, and a facsimile function. In these example embodiments, any paper such as image forming paper or recording paper can be used as a recording medium, but the recording medium is not restricted to these. Other forms of recording media may also be used, such as overhead projector sheets, for example.

Example Embodiment 1

Explanation of the Configuration of the Compound Machine as a Whole

Figure 1:
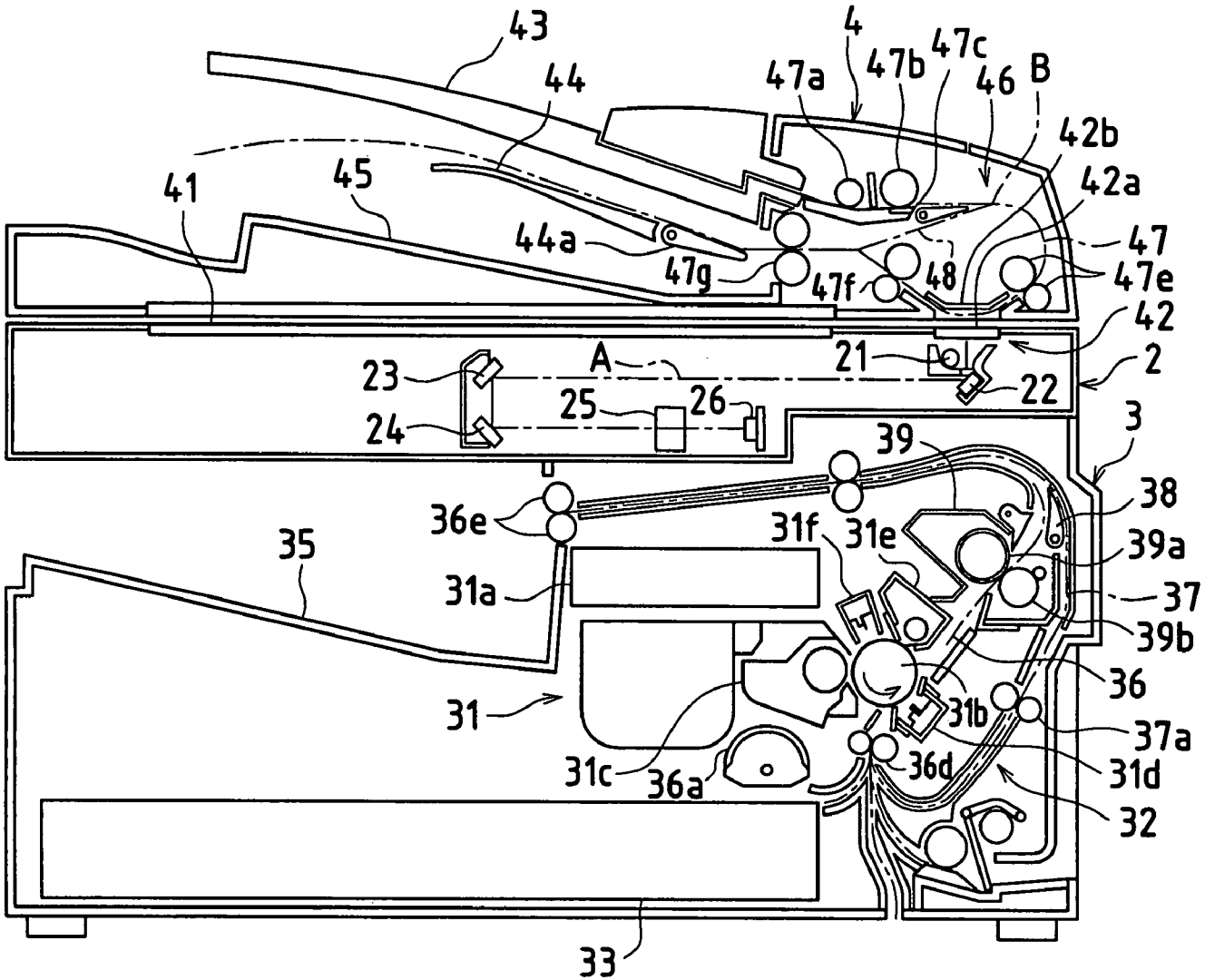
FIG. 1 is a drawing that schematically shows an internal structure of a compound machine according to an example embodiment.

FIG. 1 schematically shows an overview of the internal structure of a compound machine 1 as an image forming apparatus according to the present example embodiment. As shown in FIG. 1, the compound machine 1 includes a scanner portion 2, a print portion 3 as an image forming portion, and an automatic original paper feed portion 4. These parts are described below.

<Description of The Scanner Portion 2>

The scanner portion 2 reads the image of an original placed on an original stage 41 that is made of transparent glass, or the like, or the image of an original that is supplied sheet by sheet from the automatic original paper feed portion 4, and creates image data. This scanner portion 2 includes an exposure light source 21, a plurality of reflective mirrors 22, 23, and 24, an imaging lens 25, and a photoelectric transducer (CCD: Charge Coupled Device) 26.

The exposure light source 21 irradiates light onto the original that is placed on the original stage 41 of the automatic original paper feed portion 4 or the original carried by the automatic original paper feed portion 4. As shown in FIG. 1 by the dotted line A indicating the optical path, the reflective mirrors 22, 23, and 24 are set so as to first reflect the light that is reflected from the original to the left of the diagram, after which they reflect the light downward, and after which they then reflect the light rightward toward the imaging lens 25.

As the operation to read the image of the original, if the original is placed on the original stage 41 (if used in the "stationary sheet mode"), then the exposure light source 21 and the reflective mirrors 22, 23, and 24 horizontally scan the original stage 41 to read in the image of the entire original. On the other hand, if reading in an original that is carried by the automatic original paper feed portion 4 (if used in the "moving sheet mode"), the exposure light source 21 and the reflective mirrors 22, 23, and 24 are fixed in the position shown in FIG. 1, and the image of the original is read in as the original passes a reading portion 42 of the automatic original paper feed portion 4, described later.

Light that is reflected by the reflecting mirrors 22, 23, and 24 to pass through the imaging lens 25 is guided to the CCD 26, and the reflected light is converted into an electrical signal (original image data) by the CCD 26.

<Description of The Print Portion 3>

The print portion 3 includes an image forming system 31 and a paper transport system 32.

The image forming system 31 includes a laser scanning unit 31*a* and a photosensitive drum 31*b* as a drum-type image transport body. The laser scanning unit 31*a* irradiates laser light onto the surface of the photosensitive drum 31*b*, based on the original image data that is converted by the CCD 26. The photosensitive drum 31*b* rotates in the direction of the arrow shown in FIG. 1, and an electrostatic latent image is formed on its surface by laser light irradiated from the laser scanning unit 31*a*.

In addition to the laser scanning unit 31*a*, a development apparatus (development mechanism) 31*c*, a transfer unit 31*d* that constitutes a transfer mechanism, a cleaning apparatus (cleaning mechanism) 31*e*, a de-electrifier not shown in the drawings, and a charging unit 31*f* are circumferentially arranged in order around the photosensitive drum 31*b*. The development apparatus 31*c* uses toner (a substance for forming a manifest image) to develop the electrostatic latent image formed on the surface of the photosensitive drum 31*b* into a visible image. The transfer unit 31*d* transfers the toner image formed on the surface of the photosensitive drum 31*b* onto a piece of image forming paper (recording medium) that is a recording medium. The cleaning apparatus 31*e* removes toner remaining on the surface of the photosensitive drum 31*b* after toner transfer. The de-electrifier removes a residual electric charge from the surface of the photosensitive drum 31*b*. The charging unit 31*f* provides a predetermined electric potential to the surface of the photosensitive drum 31*b* before the electrostatic latent image is formed.

Thus, when forming an image on the image forming paper, the surface of the photosensitive drum 31*b* is charge to a predetermined electric potential by the charging unit 31*f*, and then the laser scanning unit 31*a* irradiates laser light onto the surface of the photosensitive drum 31*b* based on the original image data. After this, the development apparatus 31*c* uses toner to develop a visible image on the surface of the photosensitive drum 31*b*, and the toner image is transferred to image forming paper by the transfer unit 31*d*. Further still, after this, the cleaning apparatus 31*e* removes the toner remaining on the surface of the photosensitive drum 31*b* and the de-electrifier removes the electric charge remaining on the surface of the photosensitive drum 31*b*. Thus, one cycle of the operation to form an image on the image forming paper (printing operation) is complete. By repeating this cycle, it is possible to successively form images on a plurality of sheets of image forming paper.

On the other hand, the paper transport system 32 carries image forming paper contained in a paper cassette 33, which is a paper containing portion, sheet by sheet to form images according to the image forming system 31, and discharges the image forming paper on which an image has been formed to a discharge tray 35, which is a discharge portion.

The paper transport system 32 is provided with a principal transport path 36 and a reverse transport path 37. One end of the principal transport path 36 faces the discharge side of the paper cassette 33, while the other end faces a discharge tray 35. One end of the reverse transport path 37 is upstream (below, in the drawing) of the arranged position of the transfer unit 31*d* and is connected to the principal transport path 36, and the other end is downstream (above, in the drawing) of the arranged position of the transfer unit 31*d* and is connected to the principal transport path 36.

The upstream end of the principal transport path 36 (the part facing the discharge side of the paper cassette 33) is provided with a pickup roller 36*a* whose cross-section is semicircular. Image forming paper contained in the paper cassette 33 can be intermittently supplied sheet by sheet into the principal transport path 36 by rotating the pickup roller 36*a*.

Register rollers 36*d* are arranged in the principal transport path 36 on the upstream side of the transfer unit 31*d*. The register rollers 36*d* are rollers for matching the position of the toner image on the surface of the photosensitive drum 31*b* to the image forming paper while transporting the image forming paper. A fixing apparatus 39, that is provided with a pair of fixing rollers 39*a* and 39*b* for using heat to fix the toner image that is transferred to the image forming paper, is arranged in the principal transport path on the downstream side of the arranged position of the transfer unit 31*d*. This fixing apparatus 39 will be described in detail below. Moreover, discharge rollers 36*e* for discharging the image forming paper to the discharge tray 35 are arranged at the downstream end of the principal transport path 36.

A branch catch 38 is arranged at the position at which the upstream end of the reverse transport path 37 connects to the principal transport path 36. The branch catch 38 is rotatable around a horizontal axis between a first position, which is shown by a solid line in FIG. 1, and, rotating in a counter clockwise direction in FIG. 1 from the first position, a second position opening the reverse transport path 37. When the branch catch 38 is in the first position, the image forming paper is carried toward the discharge tray 35, and when it is in the second position, the image forming paper can be delivered into the reverse transport path 37. Transport rollers 37*a* are arranged in the reverse transport path 37, and the paper transport system 32 is arranged such that if the image forming paper is delivered into the reverse transport path 37 (if the image forming paper is fed into the reverse transport path 37 by what is known as "switchback transport"), then the image forming paper is transported by the transport rollers 37*a* and the image forming paper is reversed on the upstream side of the register roller 36*d*, and is again carried along the principal transport path 36 toward the transfer unit 31*d*. That is to say, it is handled such that an image may be formed on the back side of the image forming paper.

<Description of the Automatic Document Paper feed portion 4>

The following is a description of the automatic original paper feed portion 4. The automatic original paper feed portion 4 is configured as what is known as an automatic two-sided original transport apparatus. The automatic original paper feed portion 4 can be used for a sheet moving mode and is provided with an original tray 43 as an original placement portion, an intermediate tray 44, an original discharge tray 45 as an original discharge portion, and an original transport system 46 that transports originals between the trays 43, 44, and 45.

The original transport system 46 is provided with a main transport path 47 for transporting originals placed on the original tray 43 to the intermediate tray 44 via the original capturing portion 42 or the original discharge tray 45, and a secondary transport path 48 for supplying originals on the intermediate tray 44 to the main transport path 47.

An original pickup roller 47*a* and a fielding roller 47*b* are arranged at an upstream end (a portion facing the discharge side of the original tray 43) of the main transport path 47. A fielding board 47*c* is arranged below the fielding roller 47*b* and, due to the rotation of the original pickup roller 47*a*, one sheet of the originals on the original tray 43 passes between the fielding roller 47*b* and the fielding board 47*c* such that it is supplied to the main transport path 47. PS rollers 47*e* are arranged on a side lower than the linking area between the main transport path 47 and the secondary transport path 48 (area B in the drawing). The PS rollers 47*e* regulate the leading edge of the original and the image reading timing of the scanner portion 2 when supplying originals to the original capturing portion 42. That is, the PS rollers 47*e* temporarily stop the transport of the original in the state in which the original was supplied, and regulate the image reading timing when supplying originals to the original capturing portion 42.

The original capturing portion 42 is provided with a platen glass 42*a* and an original pressing board 42*b* and, when an original supplied from the PS rollers 47*e* passes through between the platen glass 42*a* and the original pressing board 42*b*, light from the above-mentioned exposure light source 21 passes through the platen glass 42*a* and is irradiated on the original. At this juncture, original image data is obtained by the above-mentioned scanner portion 2. A biasing force is applied to the back surface (top surface) of the original pressing board 42*b* by an unshown coil spring. In this way, the original pressing board 42*b* makes contact against the platen glass 42*a* with a predetermined suppressing force, thus preventing the original from rising up from the platen glass 42*a* when the original passes through the original capturing portion 42.

Transport rollers 47*f* and original discharge rollers 47*g* are provided on a downstream side of the platen glass 42*a*. An original that passes over the platen glass 42*a* is discharged to the intermediate tray 44 or the original discharge tray 45 via the transport rollers 47*f* and the original discharge rollers 47*g*.

An intermediate tray swinging board 44*a* is arranged between the original discharge rollers 47*g* and the intermediate tray 44. The intermediate tray swinging board 44*a* has its swinging center at an edge area of the intermediate tray 44 and is able to swing between a position 1 shown in the drawing by a solid line and a position 2 in which it is raised upwards from the position 1. When the intermediate tray swinging board 44*a* is in the position 2, an original discharged from the original discharge rollers 47*g* is withdrawn to the original discharge tray 45. On the other hand, when the intermediate tray swinging board 44*a* is in the position 1, an original discharged from the original discharge rollers 47*g* is discharged to the intermediate tray 44. When an original is discharged to the intermediate tray 44, an edge of the original is sandwiched between the original discharge rollers 47*g*, and by reversing the rotation of the original discharge rollers 47*g* while in this condition, the original is supplied to the secondary transport path 48 and is again dispatched to the main transport path 47 via the secondary transport path 48. The operation of reversing the rotation of the original discharge rollers 47*g* is carried out by regulating the dispatch of the original to the main transport path 47 and the timing of image reading. In this way, an image on the reverse side of an original can be read by the original capturing portion 42.

—Description of Basic Operation of the Compound Machine—

As the operation of the compound machine 1 configured as described above, first, this compound machine 1, when it functions as a printer, receives print data (image data or text data) sent from a host apparatus such as a personal computer, and stores this received print data in a buffer (memory) not shown. Along with storing this print data in the buffer, print data is read out from the buffer in sequence, and based on this read out print data, an image is formed on image forming paper by the image forming operation of the print portion 3 described above.

Also, when this compound machine 1 functions as a scanner, it stores the scan image data of the original read by the scanner portion 2 in the buffer. Along with storing this scan image data in the buffer, it sends the scan image data in sequence from the buffer to the host apparatus, and shows the image on a display of this host apparatus.

Further, when this compound machine 1 functions as a copy machine, an image is formed on image forming paper by the image forming operation of the print portion 3, based on the original image data read by the scanner function.

—Description of the Paper Cassette 33—

Figure 2:
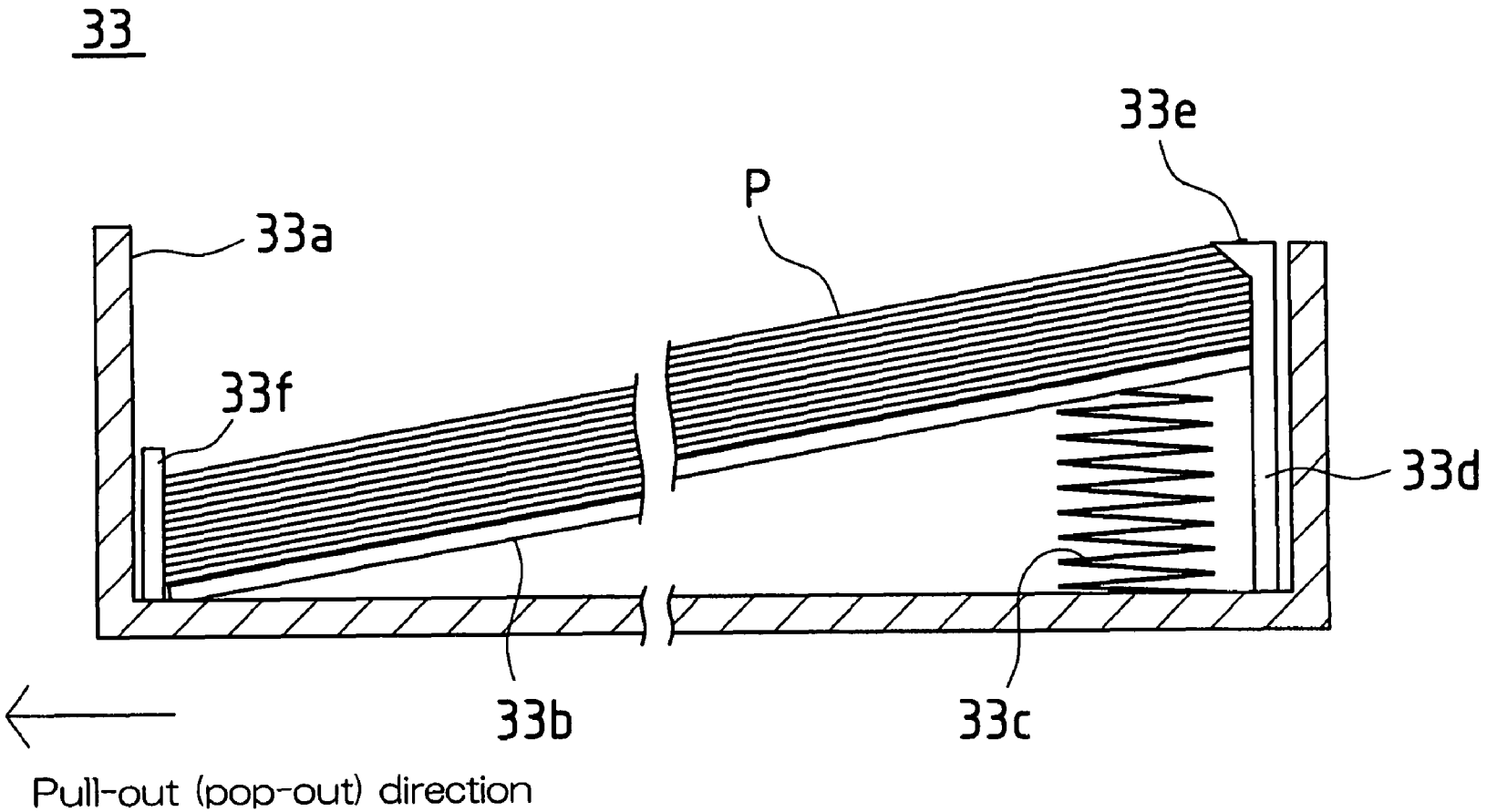
FIG. 2 is a cross-sectional view with part of the paper feed cassette omitted.

The following is an explanation of the paper feed cassette 33, which is one characteristic portion of the present example embodiment. FIG. 2 is a cross-sectional view that omits part of the paper feed cassette 33 provided in this compound machine 1. The left of the diagram is the direction that the paper feed cassette 33 is pulled out when it is pulled out from the main body of the apparatus (the direction shown by the arrow).

As shown in FIG. 2, the paper feed cassette 33 is configured such that inside a cassette main body 33*a* configured in the shape of a container that is open to the upper side, a rotating board 33*b*, which is a paper storage board made of metal, is supported so that it can rotate.

The rotating board 33*b* is supported so that it can vertically rotate around a rotational center that extends in the width direction (the direction perpendicular to the paper face in FIG. 2) on the bottom surface of the cassette main body 33*a*, and a coil spring 33*c* is compressed under that board. That is, this rotating board 33*b* constantly receives an upward biasing force from the coil spring 33*c*.

Also, a paper leading edge matching portion 33*d*, which is a matching portion made of metal for making contact with and matching the leading edge of recording paper P, is provided in an edge portion (the right edge portion in the figure) in the interior of the cassette main body 33*a*. This paper leading edge matching portion 33*d* is made of metal, and a pressing portion 33*e* is formed in its upper edge portion to press down the corner edge portion of the recording paper P from above. And, portion 33*f* in the figure is a paper trailing edge pressing portion for matching the position of the trailing edge of the recording paper P (the edge in the direction that the paper feed cassette 33 is pulled out).

Because the paper feed cassette 33 is configured in this manner, when the recording paper P is loaded into the paper feed cassette 33, the rotating board 33*b* rotates upward due to the biasing force of the coil spring 33*c*, and that position of rotation is regulated to be the position where the leading edge corner portion of the recording paper P makes contact with the pressing portion 33*e* of the paper leading edge matching portion 33*d*. That is, the position of rotation of the rotating board 33*b* is determined by the number of sheets of paper in the paper feed cassette 33, and the greater the number of sheets of recording paper P, the further downward the position of rotation of the rotating board 33*b* will become. By inserting the paper feed cassette 33 into the main body of the image forming apparatus in such a state, the uppermost sheet of recording paper P faces or makes contact with the pickup roller 36*a*, and due to rotation of this pickup roller 36*a* it is possible to supply paper from the paper feed cassette 33 towards the print portion 3.

Figure 3:
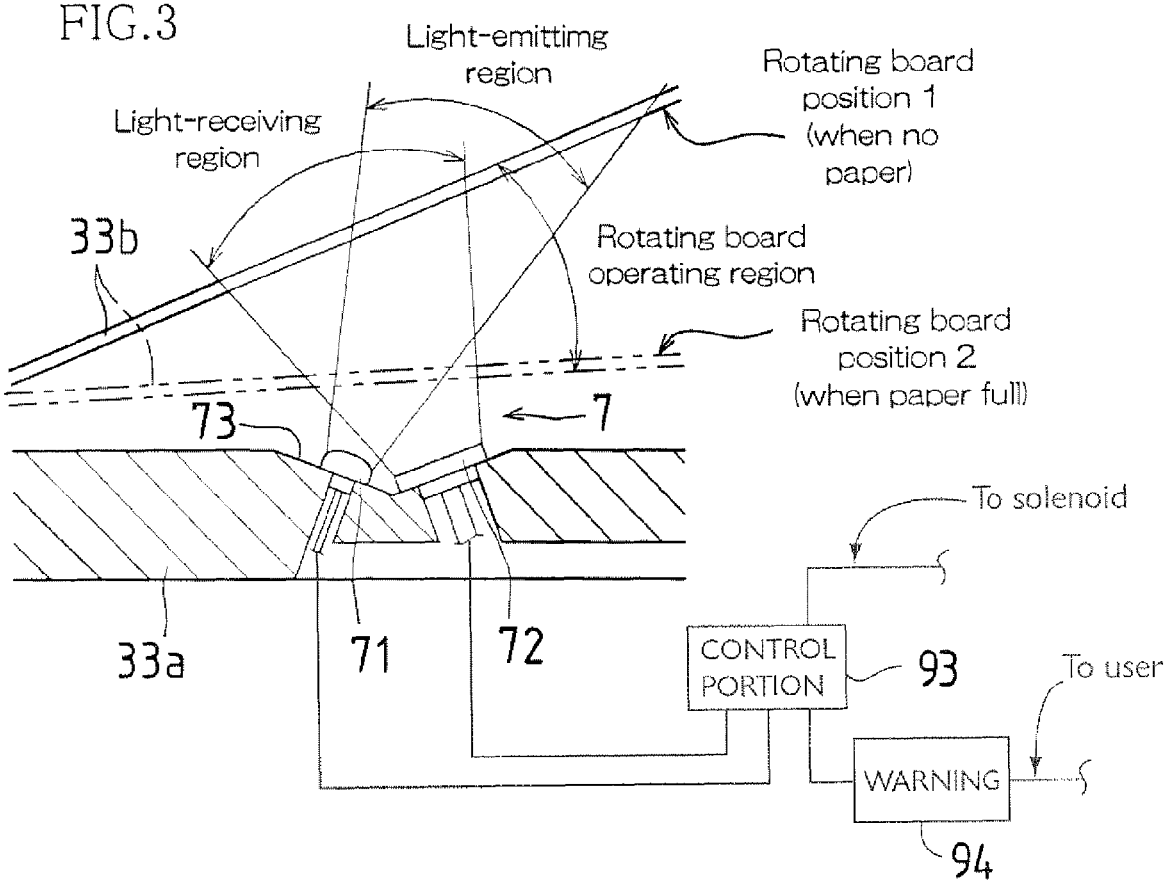
FIG. 3 is a drawing illustrating the structure and principle of the reflective optical sensor.

Also, a reflective optical sensor 7 is provided in this paper cassette 33 as a sheet quantity checking means that can check the number of sheets of recording paper P that are stored in the paper feed cassette 33. As shown in FIG. 3, this reflective light optical sensor 7 is disposed on the bottom face of the cassette main body 33*a*, and includes a light emitting portion (such as an LED) 71 that irradiates light towards the bottom face of the rotating board 33*b* and a light receiving portion (light receiving sensor) 72 that receives the light emitted toward the bottom face of the rotating board 33*b* by this light emitting portion 71. Specifically, a concave portion 73 that has been made concave in approximately a V-shape is provided, the light emitting portion 71 is installed on one of the diagonal surfaces, and the light receiving portion 72 is installed on the other diagonal surface. The light emitting portion 71 and the light receiving portion 72 are arranged slightly tilted in the direction facing each other.

Thus, as shown by a solid line in FIG. 3, when the position of rotation of the rotating board 33*b* is a position in the upper direction (when there is a low quantity of paper remaining), the overlapping area of the irradiated region of light irradiated to the bottom face of the rotating board 33*b* from the light emitting portion 71 and the region of the bottom face of the rotating board 33*b* that can receive light with the light receiving portion 72 is comparatively small, and the distance from the light emitting portion 71 and the light receiving portion 72 to the bottom face of the rotating board 33*b* is comparatively far, and so comparatively little light is received by the light receiving portion 72. Conversely, as shown by the broken line in FIG. 3, when the position of rotation of the rotating board 33*b* is in the lower direction (when there is a large quantity of paper remaining), the overlapping area of the irradiated region of light irradiated to the bottom face of the rotating board 33*b* from the light emitting portion 71 and the region of the bottom face of the rotating board 33*b* that can receive light with the light receiving portion 72 is comparatively large, and the distance from the light emitting portion 71 and the light receiving portion 72 to the bottom face of the rotating board 33*b* is comparatively close, and so a comparatively large amount of light is received by the light receiving portion 72. In this way, because the position of rotation of the rotating board 33*b* can be confirmed by the amount of light received by the light receiving portion 72, the number of sheets of paper in the paper feed cassette 33 can also be confirmed by the amount of light received. That is, a configuration is adopted wherein the less sheets there are in the paper feed cassette 33, the less light is received.

Figure 4:
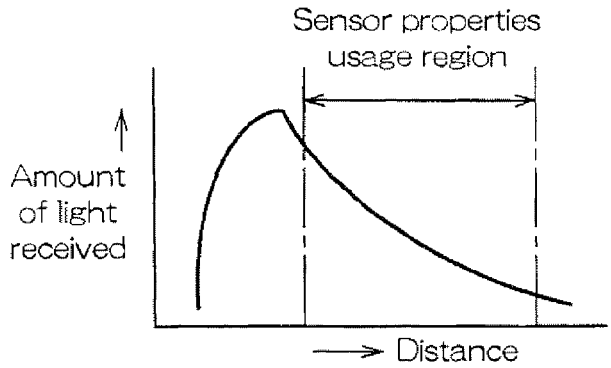
FIG. 4A is a drawing that shows the relationship between the distance to the reflective surface when the light receiving portion detects the reflective surface of the light and the output level corresponding to the amount of light received.
FIG. 4B is a drawing that shows the characteristic regions in which the reflective optical sensor operates.
Figure 4:
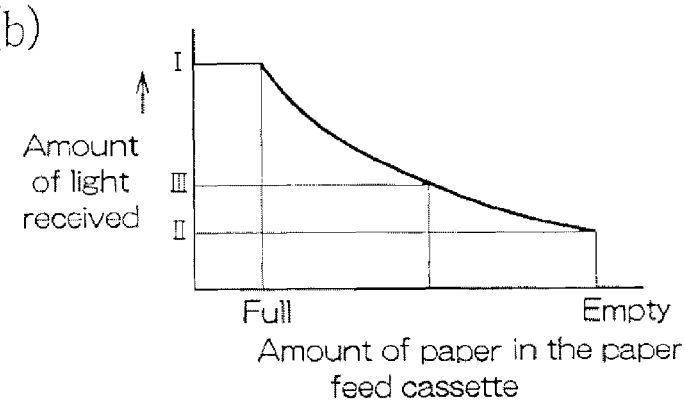

FIG. 4(*a*) shows the relationship between the distance to the reflective surface when the light-receiving portion 72 detects the reflective surface of the light and the output level corresponding to the amount of light received. In this example embodiment, among the properties of this light receiving portion 72, it is made such that the number of sheets of paper in the paper feed cassette 33 can be confirmed using the region in which the amount of light received gradually decreases as the distance to the reflective face increases (see FIG. 4(*b*)). That is, when the amount of light received is I in the figure, it is confirmed that the paper feed cassette 33 is full of recording paper P, and when the amount of light received is II, it is confirmed that the paper feed cassette 33 is empty. Also, when the amount of light received is between I and II, the number of sheets of recording paper P is confirmed according to that amount of light received. For example, in a paper feed cassette that can store 500 sheets of recording paper P, when the amount of light received is III, it is confirmed that there are 250 sheets of recording paper P stored in the paper feed cassette 33.

Figure 5:
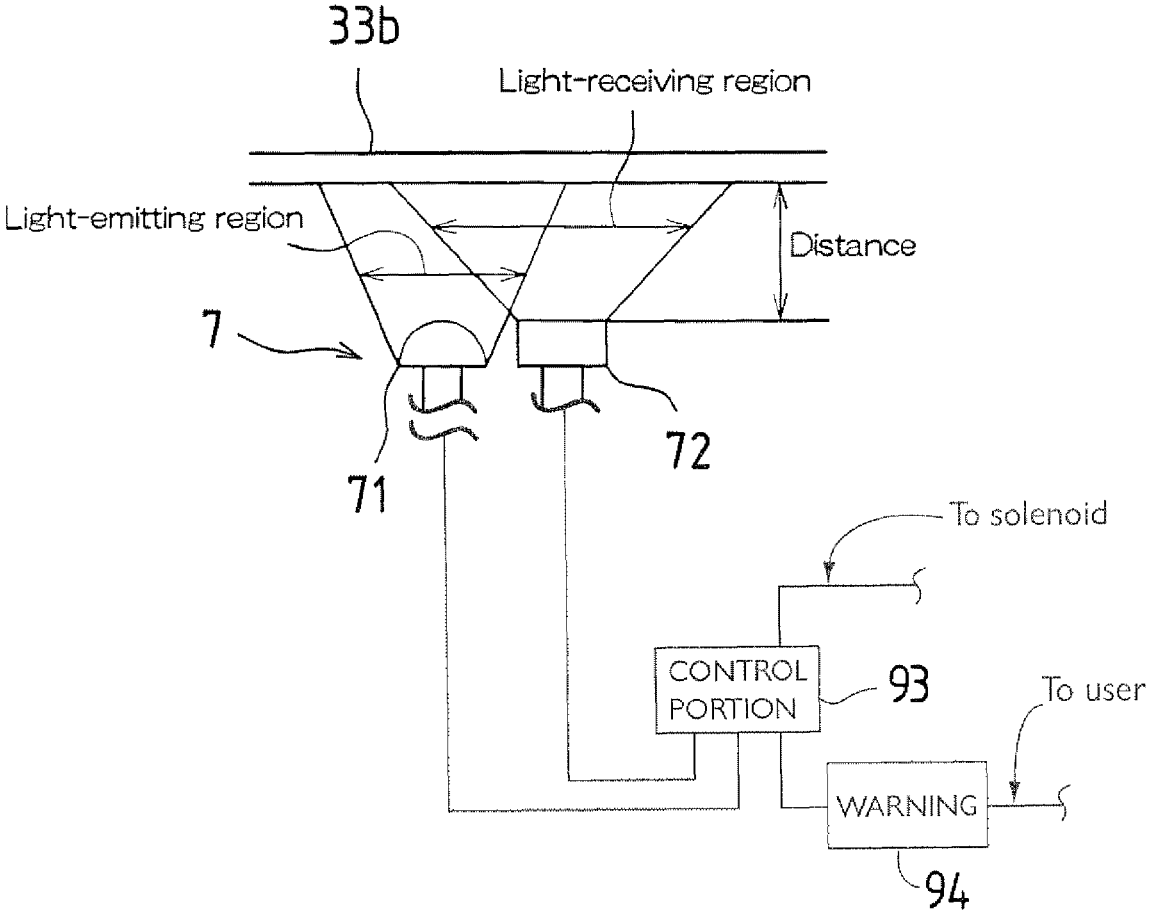
FIG. 5 is a drawing that shows a modified example of the reflective optical sensor.

In the present example embodiment, the light emitting portion 71 and the light receiving portion 72 are disposed in the approximately V-shaped concave portion 73, but as shown in FIG. 5, the light emitting portion 71 and the light receiving portion 72 may also be disposed on the same flat surface.

—Description of the Push-Out Mechanism—

Figure 6:
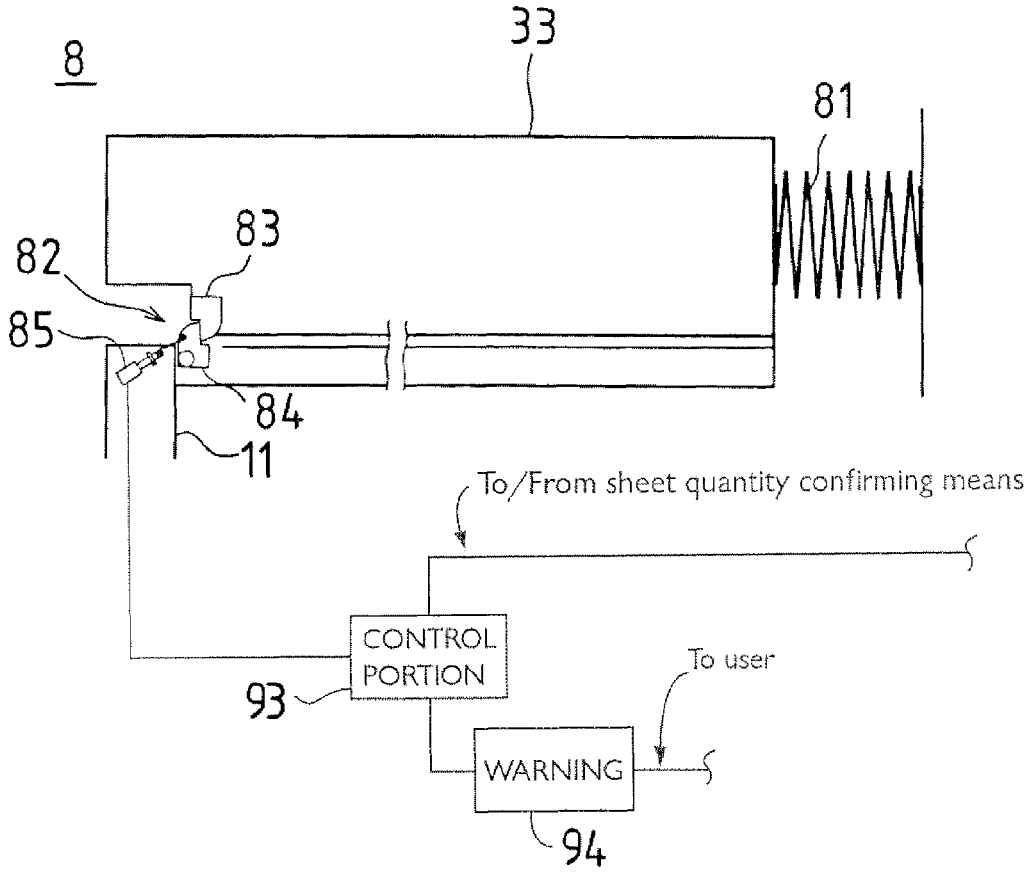
FIG. 6 is a drawing that shows the push-out mechanism.

Following is a description of a push-out mechanism 8, which is a push-out means wherein it is possible to push out the paper feed cassette 33 from an installed state towards an uninstalled state. FIG. 6 shows this push-out mechanism 8. As shown in this figure, the push-out mechanism 8 is provided with a coil spring 81 as a biasing portion that confers a biasing force in the direction that puts the paper feed cassette 33 in an uninstalled state, and an engaging mechanism 82 that can switch between the engaged state and the disengaged state of the paper feed cassette 33 with respect to the main body of the apparatus.

The coil spring 81 is compressed between the side of the paper feed cassette 33 (the insertion side when inserting the cassette into the main body of the apparatus) and the inner surface of the main body of the apparatus, and in a state in which the paper feed cassette 33 is installed in the main body of the apparatus, a biasing force is constantly conferred in the direction that will uninstall the cassette (the push-out direction: the left direction in FIG. 6).

On the other hand, the engaging mechanism 82 is provided with a fixed catch 83 fixed on the lower edge of the side of the paper feed cassette 33 (the push-out side when pushing out the cassette from the main body of the apparatus), and a movable catch 84 supported so that it can rotate around the horizontal axis relative to the main body of the apparatus. This movable catch 84 is connected via a connecting portion 87 comprising a coil spring or the like to a leading edge portion of a rising and setting rod 86 that extends from a solenoid 85 installed in an apparatus frame 11. Thus, in an unexcited state of the solenoid 85, the movable catch 84 becomes engaged with the fixed catch 83, and a state is maintained in which the paper feed cassette 33 is installed in the main body of the apparatus (the state in FIG. 6 and FIG. 7(*a*)). On the other hand, in an excited state of the solenoid 85, the rod 86 sinks in, the movable catch 84 moves in the direction escaping from the fixed catch 83, and releases the paper feed cassette 33 (the state in FIG. 7(*b*)). Thus, the paper feed cassette 33 is pushed out in the direction in which it becomes uninstalled (the push-out-direction) by the biasing force of the coil spring 81.

—Description of an Example Control Portion/Control Means—

A control portion/control means 93 that performs overall control over this compound machine 1 receives a signal from the light receiving portion 72, and is switched between an excited and an unexcited state of the solenoid 85 of the engaging mechanism 82. Specifically, this control portion 93 causes the number of sheets of recording paper P stored in the paper feed cassette 33 to be confirmed by the reflective optical sensor 7 when an image forming request is received from a terminal device, and when the number of sheets of recording paper P stored in the paper feed cassette 33 is lower than the requested number of image forming sheets, causes the paper feed cassette 33 to be pushed out from an installed state toward an uninstalled state by the push-out mechanism 8, without executing an image forming operation. That is, it puts the paper feed cassette 33 in a released state by exciting the solenoid 85, and thereby causes the paper feed cassette to be pushed out in the direction such that it is uninstalled (the push-out direction).

Also, the main compound machine 1 is provided with a warning means 94 that can emit a warning to a user (terminal device) that has made an image forming request, and when putting the paper feed cassette in a released state, gives a warning to the user with the warning means 94 to the effect that the number of sheets of recording paper is insufficient. Specifically, it displays a message such as "There is not enough paper" on the display of the terminal device that the user is operating. And, besides the message display on the terminal device that the user is operating, as another example, a warning means 94 may also be configured wherein an auditory warning is given to the user from the main compound machine 1, and further, a warning means 94 may also be configured wherein a message display and an auditory warning are given to the user.

—Description of the Operating Procedure—

Figure 8:
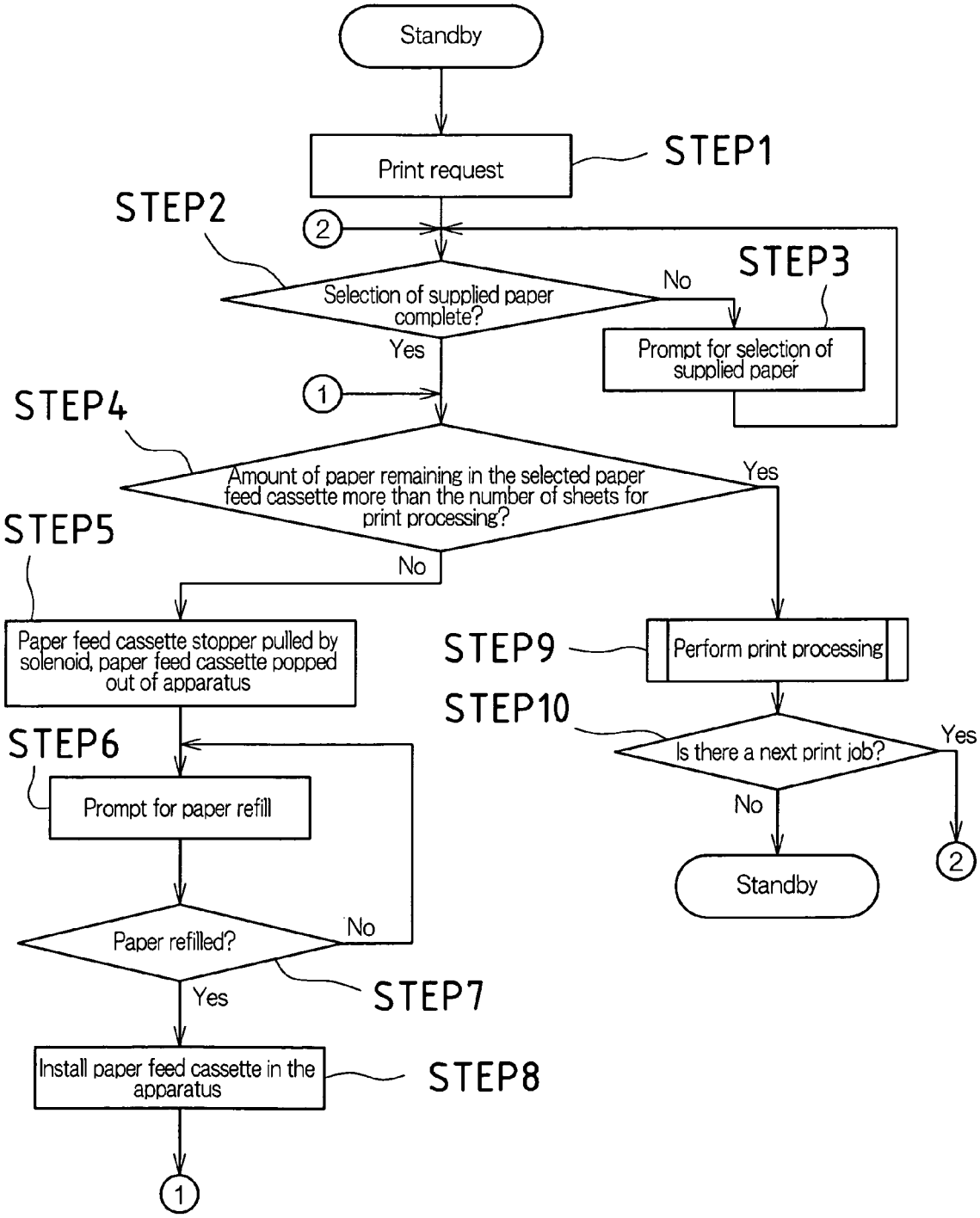
FIG. 8 is a flowchart that illustrates the print operation of the compound machine.

Following is a description of the printing operation of the compound machine 1 with reference to the flowchart in FIG. 8. First, in Step 1, a printing request is made to the main compound machine 1, and in Step 2, completion of input of the supplied paper selection (print processing condition) is awaited. If there is no input of a supplied paper selection, a notifying operation is performed to prompt the user for input of a supplied paper selection. That is, a message such as "Please select the supplied paper" is displayed on the display of the terminal device that the user is operating.

When the supplied paper selection is input, (judged 'yes' in Step 2), the procedure advances to Step 4, and it is judged whether the amount of paper in the selected paper feed cassette 33 is greater than the number of print processing sheets or not. Then, if this judgment is 'Yes', then the solenoid 85 is kept non-electrified and print processing is executed for the paper (Step 9). After this print processing is executed, image forming is successively performed in turn while judging the presence or absence of something to be printed next, and when image forming is complete for all of the image data, a "standby state" is entered that waits for the next print request.

Figure 7A:
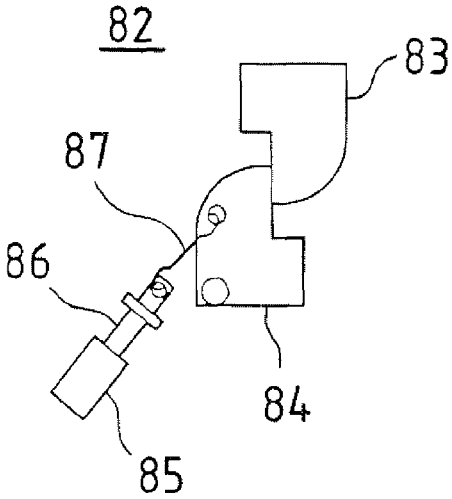
FIG. 7 is a drawing illustrating the engaging mechanism.
Figure 7B:
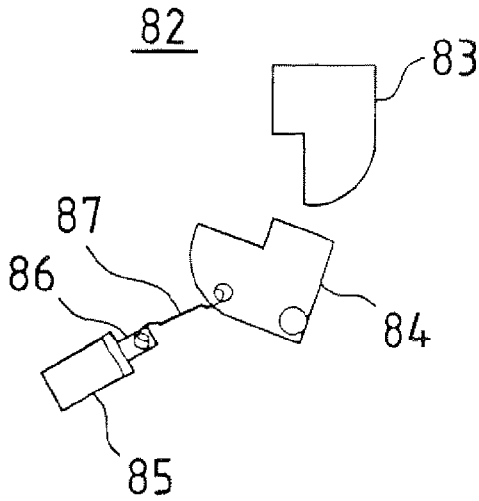

On the other hand, when 'No' is judged (judged that the amount of paper in the selected paper feed cassette 33 is lower than the number of print processing sheets) in Step 4, the procedure advances to Step 5, a current is sent through the solenoid 85, sinking in the rod 86, and causing the movable catch 84 to rotate in the direction that frees it from the fixed catch 83 (see FIG. 7(*b*)). Thus, the paper feed cassette 83 becomes released, and the paper feed cassette 33 is pushed out in the direction that it becomes uninstalled (the push-out direction) by the biasing force of the coil spring 81.

And, along with this push-out operation of the paper feed cassette 33, in Step 6, a display signal is sent for producing a display for prompting a paper refill to the terminal device that sent out the print request signal.

After that, in Step 7, it is judged whether or not the paper has been refilled, and when this judgment is 'Yes', the current flowing through the solenoid 85 is turned off, the rod 86 returns to a protruding state, and thus the movable catch 84 also enters a standing state. In this state, the paper feed cassette 33 is pushed in towards the main body of the apparatus with a manual operation by the user, and when the fixed catch 83 surmounts the movable catch 84 and is pressed in to a predetermined installed position, the fixed catch 83 is engaged by the movable catch 84, and the installed state of the paper feed cassette 33 is preserved (see FIG. 6 and FIG. 7(*a*)).

Effect of Example Embodiment

As explained above, in the present example embodiment, when the number of sheets of paper remaining in the paper feed cassette 33, confirmed by the reflective optical sensor 7, is lower than the requested number of image forming sheets, that is, in a circumstance in which paper will run out during execution if an image forming operation is executed as-is, without beginning an image forming operation, along with pushing the paper feed cassette out from an installed state toward an uninstalled state with the push-out mechanism 8, a warning is given to the user by a warning means 94 to the effect that the number of sheets of recording paper is insufficient. Thus the user, after sending a print request, immediately confirms that a refill of the recording paper is necessary, and it is possible to immediately begin the work of refilling the paper without requiring the user to check the status of the compound machine 1. Accordingly, when the refill recording paper is stored in a different location than the compound machine 1 is installed, it is possible for the user to go to the storage location of the refill recording paper to get recording paper, without going to the installed location of the compound machine 1, then go to the installed location of the compound machine 1 and perform the work of refilling the paper. That is, the activity of approaching the installed location of the compound machine 1 and confirming that there is no paper, remaining prior to going to get recording paper from the storage location, is no longer necessary. After sending an image request signal from the terminal to the compound machine 1, it is possible to allow the user to confirm the lack of paper within a short period of time. That is, after the user has sent an image request signal and before beginning separate work on that terminal, it is possible to prompt the user for a paper refill as necessary, and so it is possible to avoid temporarily interrupting work on the terminal.

Also, when performing a copy operation in the main compound machine 1, if the number of recording sheets P stored in the paper feed cassette 33 is lower than the number of requested copy sheets, without beginning the copy operation, along with the paper feed cassette being slightly pushing out, a message such as "There is not enough paper" is displayed on the operating panel of the compound machine 1. In this case as well, it is possible for the user to immediately begin the work of refilling the paper without checking inside of the paper feed cassette 33.

Second Example Embodiment

Next is an explanation of a second example embodiment of the present technology. In the first example embodiment described above, the reflective optical sensor 7 was adopted as a sheet quantity checking means that checks the number of sheets of recording paper that are in the paper feed cassette 33. This second example embodiment is a modified example of this sheet quantity checking means, and in other respects the configuration of this second example embodiment is the same as in the first example embodiment described above. Accordingly, only points differing from the first example embodiment will be explained.

Figure 9A:
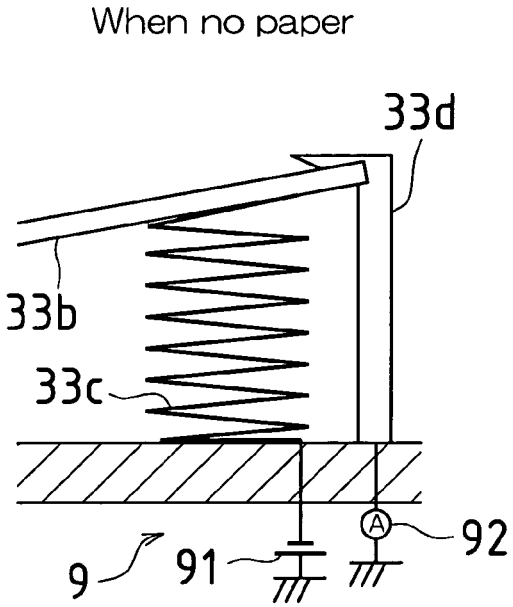
FIG. 9 is cross-sectional view that shows a part of the interior of the paper feed cassette according to a second example embodiment.
Figure 9B:
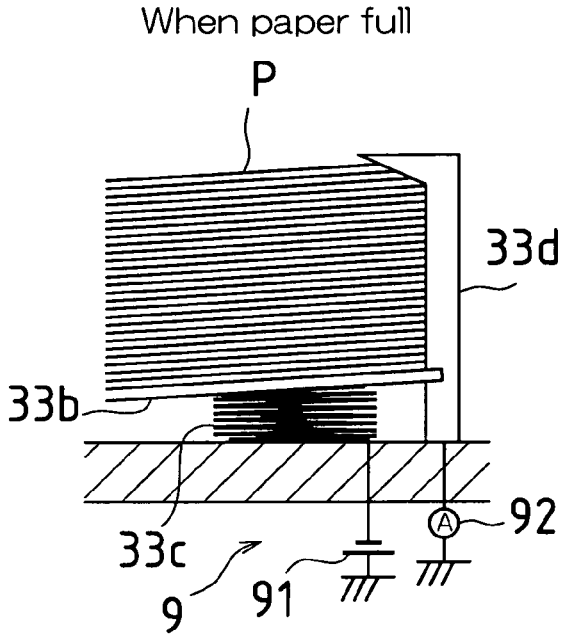

FIG. 9 is a cross-sectional view that shows a part of the interior of the paper feed cassette 33 according to the present example embodiment, which shows the structure for checking the number of recording sheets in the paper feed cassette 33. As shown in FIG. 9, the sheet quantity checking means 9 is provided with a direct current power source 91 that applies a direct current voltage across the aforementioned coil spring 33*c*, rotating board 33*b*, and paper leading edge matching portion 33*d*, and an electrical current sensor that detects its electrical current value.

Figure 10:
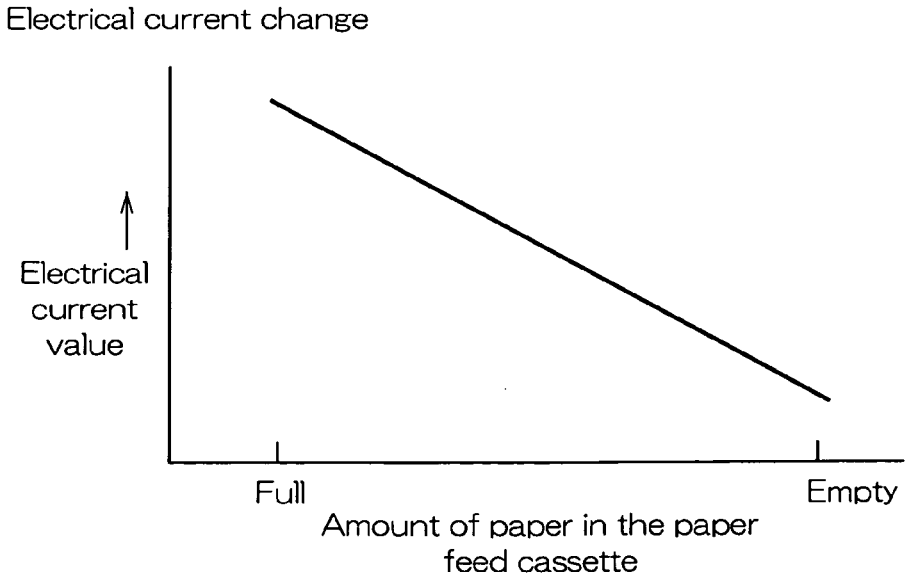
FIG. 10 is a drawing that shows the relationship between the number of sheets of paper in the paper feed cassette and the electric current value detected by the electric current sensor.

As previously stated, the position of rotation of the rotating board 33*b* is determined according to the number of sheets of recording paper P that are in the paper feed cassette 33, and the greater the number of sheets of recording paper P, the further the position of rotation of the rotating board 33*b* moves downward. That is, as shown in FIG. 9(*a*), when the number of sheets of recording paper P is small, the rotating board 33*b* makes contact in the vicinity of the upper edge portion of the paper leading edge matching portion 33*d*. Thus, the electrical resistance across the aforementioned coil spring 33*c*, rotating board 33*b*, and paper leading edge matching portion 33*d* is comparatively large, and the electrical current value detected by the electrical current sensor 92 is detected as a small value. On the other hand, as shown in FIG. 9(*b*), when the number of sheets of recording paper P is large, the rotating board 33*b* makes contact in the vicinity of the lower edge portion of the paper leading edge matching portion 33*d*. Thus, the electrical resistance across the aforementioned coil spring 33*c*, rotating board 33*b*, and paper leading edge matching portion 33*d* becomes comparatively small, and the electrical current value detected by the electrical current sensor 92 is detected as a large value. FIG. 10 shows the relationship between the number of sheets of paper in the paper feed cassette 33 and the electrical current value detected by the electrical current sensor 92.

In this way, the present example embodiment effectively applies the fact that, from the related art, the rotating board 33*b* and the paper leading edge matching portion 33*d* are made of metal. By utilizing the fact that the electrical resistance changes according to the position of rotation of the rotating board 33*b*, because the position at which the rotating board 33*b* makes contact with the paper leading edge matching portion 33*d* changes, it is possible to confirm the number of sheets of recording paper without requiring a special electric circuit.

Other Example Embodiments

In the example embodiments described above, the present technology was described with respect to its application in the multifunction-type image forming apparatus (compound machine) 1 including functions as a copy machine and printer and facsimile apparatuses. The present invention is not restricted to this, and can also be applied in an image forming apparatus provided with only some single function, or in another image forming apparatus.

And, in the example embodiments described above, a configuration was adopted wherein the number of sheets of paper in the paper feed cassette 33 is confirmed based on the electrical resistance from the reflective optical sensor 7 and the coil spring 33*c* to the paper leading edge matching portion 33*d*. The present invention is not limited to this configuration; a configuration may also be adopted wherein the number of sheets of paper in the paper feed cassette 33 is confirmed based on the value of a counter that counts the number of sheets printed. For example, a configuration may be adopted in which the counter is reset in a state in which paper is fully stored in the paper feed cassette 33, and afterwards the number of sheets of paper in the paper feed cassette 33 is confirmed by subtracting the number of sheets printed from the number of sheets when full.

In the above manner, in the present technology, when forming an image, if there are not enough sheets of paper remaining to satisfy that request, without executing that image forming operation, a paper refill is awaited, and the image forming operation begins after that paper refill. When waiting for this paper refill, along with prompting the user for the paper refill, the paper feed cassette is popped out and the lack of paper can easily be confirmed. Thus, the user can, after sending an image forming request, immediately confirm that a refill of the storage medium (paper) is necessary, and immediately begin the work of refilling the paper without the need to confirm the status of the image forming apparatus. Thus, the activity of approaching the installed location of the image forming apparatus and confirming that there is no paper remaining, prior to going to get recording paper from the storage location of the recording medium, is no longer necessary. And, it is possible to allow the user to confirm the lack of paper within a short period of time after sending an image request signal from a terminal to the image forming apparatus. That is, after the user has sent an image request signal and before beginning separate work on that terminal, it is possible to prompt the user for a paper refill as necessary, and so it is possible to avoid temporarily interrupting work on the terminal.

As a sheet quantity checking means, if the number of sheets of the storage medium stored in the paper feed cassette is confirmed by turning on electricity from a paper storage board made of metal to a matching portion, and detecting the electrical resistance from the paper storage board to the matching portion, which changes according to the height position of the paper storage board, it becomes possible to confirm the number of sheets of recording paper without requiring a special electric circuit, and lower cost can be achieved.

The present invention may be embodied in other forms without departing from the gist or essential characteristics thereof. The example embodiments disclosed in this application are to be considered in all respects as illustrative and not limiting. The scope of the invention is indicated by the appended claims rather than by the foregoing description, and all changes that come within the meaning and range of equivalency of the claims are intended to be embraced therein.

This application claims priority on Patent Application No. 2003-121899 filed in Japan on Apr. 25, 2003, the entire contents of which are hereby incorporated by reference.

INDUSTRIAL APPLICABILITY

The present technology is applicable to image forming apparatuses that can form an image; these are not limited to copy machines, printer and facsimile apparatuses, and the like.

The invention claimed is:

1. An image forming apparatus, provided with a paper feed cassette and an image forming portion, that takes out a recording medium stored in this paper feed cassette sheet by sheet in response to an image forming request and performs image forming in the image forming portion, the image forming apparatus comprising:

a push-out means that can push out the paper feed cassette from an installed state toward an uninstalled state relative to a main body of the image forming apparatus;

a sheet quantity confirming means that can confirm the number of sheets of the recording medium stored in the paper feed cassette; and a control means;

wherein said image forming apparatus is configured to communicate with a terminal machine;

wherein said image forming apparatus is located in a first location and said terminal machine is located in a second location;

wherein said image forming apparatus is configured to receive an image forming request from said terminal machine;

wherein the control means is configured to cause, immediately after the image forming apparatus receives said image forming request from said terminal machine, the sheet quantity confirming means to confirm the number of sheets of the recording medium stored in the paper feed cassette, wherein the control means is configured to cause, if the number of sheets of the recording medium stored in the paper feed cassette is lower than the number of sheets necessary to complete an image forming operation in accordance with the image forming request, the paper feed cassette to be pushed out from an installed state toward an uninstalled state by the push-out means without commencing the image forming operation, and to cause the user to be warned that the number of sheets of the recording medium is insufficient to complete the image forming operation in accordance with the image forming request; and wherein said warning is provided at the terminal machine.

2. The image forming apparatus according to claim 1, further comprising a paper storage board that supports a recording medium and moves to a lower position as the number of stored sheets of the recording medium increases;

wherein the sheet quantity confirming means is configured to confirm the number of sheets of the recording medium stored in the paper feed cassette by detecting a height position of the paper storage board with a reflective optical sensor.

3. The image forming apparatus according to claim 1, wherein the paper feed cassette comprises:

a matching portion made of metal that extends in the vertical direction along the edge of the stored recording medium and matches the recording medium; and a paper storage board made of metal that is movable along this matching portion in the vertical direction while contacting this matching portion and that is configured to move to a lower position as the number of stored sheets of the recording medium increases;

wherein the sheet quantity confirming means is configured to let a current flow from the paper storage board to the matching portion, and is configured to confirm the number of sheets of the recording medium stored in the paper feed cassette based on the electrical resistance from the paper storage board to the matching portion, which changes according to the height position of the paper storage board.

4. The image forming apparatus according to claim 1, wherein the push-out means comprises:

an engaging mechanism that can switch between an engaged state and a released state of the paper feed cassette relative to the main body of the image forming apparatus; and a biasing portion that confers a biasing force on the paper feed cassette in the push-out direction; and wherein when the number of sheets of the recording medium stored in the paper feed cassette is lower than the requested number of image forming sheets, the engaging mechanism is configured to put the paper feed cassette in a released state relative to the main body of the image forming apparatus.

5. The image forming apparatus according to claim 1, wherein the control means is configured to cause, immediately after the image forming request has been received by the image forming apparatus and before commencement of the image forming operation in accordance with the image forming request, the sheet quantity confirming means to confirm the number of sheets of the recording medium stored in the paper feed cassette, and wherein the control means is configured to cause, if the number of sheets of the recording medium stored in the paper feed cassette is lower than the number of sheets requested by the image forming request, the paper feed cassette to be pushed out from the installed state toward the uninstalled state by the push-out means without commencing the image forming operation, and wherein the control means is configured to cause the user to be warned that the number of sheets of the recording medium is insufficient.

6. The image forming apparatus of claim 1, further comprising a warning means configured to emit a warning that the number of sheets of the recording medium is insufficient to complete the image forming operation in accordance with the image forming request.

7. An image forming apparatus, comprising:

a paper feed cassette configured to contain paper sheets;

a paper sheet quantifier configured to determine the number of paper sheets contained in the paper feed cassette;

an image forming portion configured to form an image on one or more of said paper sheets in response to an image forming request;

a control portion configured to cause, in immediate response to said image forming request, said paper sheet quantifier to determine the number of paper sheets contained in the paper feed cassette;

wherein said control portion is further configured to cause, prior to commencement of an image forming job in response to said image forming request, the provision of a warning that the number of paper sheets contained in the paper feed cassette is insufficient to complete said image forming job in response to said image forming request; and a paper feed cassette ejector configured to push out the paper feed cassette from an installed state toward an uninstalled state relative to a main body of the image forming apparatus;

wherein said image forming apparatus is further structured to withhold commencement of said image forming job if the number of paper sheets contained in the paper feed cassette is insufficient to complete said image forming job in response to said image forming request; and wherein said control portion is further configured to withhold said commencement of said image forming job by causing said paper feed cassette ejector to push out the paper feed cassette from an installed state toward an uninstalled state relative to the main body of the image forming apparatus.

8. The image forming apparatus of claim 7, wherein the paper feed cassette comprises said paper sheet quantifier:

wherein said paper sheet quantifier comprises:

a metal portion of said paper feed cassette that extends in the vertical direction along an edge of said one or more paper sheets contained in said paper feed cassette;

a movable paper storage board supporting said one or more paper sheets, wherein a position of the paper storage board is dependant upon the number of paper sheets contained in said paper feed cassette;

wherein said paper storage board comprises metal and is movable along said portion in the vertical direction while contacting said portion;

wherein electrical resistance between the paper storage board and said metal portion is dependant upon a height position of the paper storage board; and wherein said paper sheet quantifier is configured to permit a current flow from the paper storage board to said metal portion and to confirm the number of paper sheets contained in the paper feed cassette based on electrical resistance from the paper storage board to said metal portion.

9. The image forming apparatus of claim 7, wherein said warning comprises a visual warning.

10. The image forming apparatus of claim 7, wherein said warning comprises an auditory warning.

11. The image forming apparatus of claim 7, wherein said warning comprises a visual warning and an auditory warning.

12. The image forming apparatus of claim 7, wherein said control portion is further configured to withhold commencement of said image forming job if the number of paper sheets contained in the paper feed cassette is insufficient to complete said image forming job in response to said image forming request.

13. The image forming apparatus of claim 7, wherein said image forming apparatus is further configured to withhold said commencement of said image forming job by switching between an engaged state and a released state of the paper feed cassette.

* * * * *